US012138677B2

(12) United States Patent
Fabris et al.

(10) Patent No.: US 12,138,677 B2
(45) Date of Patent: Nov. 12, 2024

(54) BENDING MACHINE FOR METAL SHEETS

(71) Applicant: SALVAGNINI ITALIA S.P.A., Sarego (IT)

(72) Inventors: Stefano Fabris, Vicenza (IT); Giulio Farina, Biassono (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 705 days.

(21) Appl. No.: 16/613,217

(22) PCT Filed: May 11, 2018

(86) PCT No.: PCT/IB2018/053287
§ 371 (c)(1),
(2) Date: Nov. 13, 2019

(87) PCT Pub. No.: WO2018/211381
PCT Pub. Date: Nov. 22, 2018

(65) Prior Publication Data

US 2020/0114407 A1 Apr. 16, 2020

(30) Foreign Application Priority Data

May 15, 2017 (IT) ..... 102017000052500

(51) Int. Cl.
*B21D 5/02* (2006.01)

(52) U.S. Cl.
CPC ..... *B21D 5/0227* (2013.01)

(58) Field of Classification Search
CPC .. B21D 5/0218; B21D 5/0227; B21D 5/0236; B21D 5/0254; B21D 5/02; B23Q 3/155;
(Continued)

(56) References Cited

U.S. PATENT DOCUMENTS 4,188,815 A * 2/1980 Mizushima ..... B21D 5/0254 483/29
5,410,904 A 5/1995 Hirata et al.
(Continued)

FOREIGN PATENT DOCUMENTS

CH 688035 A5 * 11/1988 ..... B21D 5/02
CN 204975004 1/2016
(Continued)

OTHER PUBLICATIONS

Translation; CH688035 A5, Lundmark et al. Nov. 1998.*
(Continued)

*Primary Examiner* — Edward T Tolan
(74) *Attorney, Agent, or Firm* — Wenderoth, Lind & Ponack, L.L.P.

(57) ABSTRACT

A bending machine for metal sheets includes a punching arrangement that supports upper bending tools, a die arrangement that supports lower bending tools, and a back gauge unit movable inside an operating area and arranged to position a workpiece. The back gauge unit has a hooking element to engage at least one lower bending tool to move it along the bending direction. The lower bending tools include a set of side lower bending tools that are positionable in a non-operative configuration outside the operating area and unreachable by the back gauge unit. The side lower bending tools are connectable to one another to form a group selectable in number. At least one of the side lower bending tools of the group is positioned in the non-operative configuration inside the operating area to be engaged by the hooking element and movable along the bending direction together with the group.

13 Claims, 5 Drawing Sheets

(58) Field of Classification Search
CPC ..... B23Q 3/15513; B23Q 3/1554; B23Q 2003/155404; B23Q 3/1556; B23Q 3/15573
See application file for complete search history.

(56) References Cited

U.S. PATENT DOCUMENTS

| | | | | |
|---|---|---|---|---|
| 5,941,116 | A * | 8/1999 | Kunze | B21D 5/045 72/306 |
| 7,901,341 | B2 | 3/2011 | Shimizu et al. | |
| 9,975,161 | B2 | 5/2018 | Sato | |
| 10,293,394 | B2 * | 5/2019 | Sato | B21D 5/0236 |
| 10,369,608 | B2 | 8/2019 | Sato | |
| 10,500,623 | B2 | 12/2019 | Meneghetti | |
| 2007/0271987 | A1 | 11/2007 | Shimizu et al. | |
| 2015/0174633 | A1 | 6/2015 | Sato | |
| 2016/0354821 | A1 | 12/2016 | Meneghetti | |
| 2017/0043385 | A1 * | 2/2017 | Klingesberger | B21D 5/0254 |
| 2018/0236518 | A1 | 8/2018 | Sato | |
| 2020/0316665 | A1 * | 10/2020 | Cavicchia | B21D 5/0254 |

FOREIGN PATENT DOCUMENTS

| | | | | |
|---|---|---|---|---|
| CN | 105618585 | | 6/2016 | |
| CN | 205949661 | | 2/2017 | |
| EP | 0 530 375 | | 3/1993 | |
| EP | 1 658 908 | | 5/2006 | |
| EP | 2 865 458 | | 4/2015 | |
| JP | 58-76326 | | 5/1983 | |
| JP | 60234721 | A * | 11/1985 | B21D 5/02 |
| JP | 7-275940 | | 10/1995 | |
| JP | 2006-855 | | 1/2006 | |
| JP | 2014-4604 | | 1/2014 | |
| JP | 2014-226683 | | 12/2014 | |
| JP | 2017-508623 | | 3/2017 | |
| WO | WO-2012083332 | A1 * | 6/2012 | B21D 37/04 |
| WO | 2012/151601 | | 11/2012 | |
| WO | 2015/118505 | | 8/2015 | |

OTHER PUBLICATIONS

International Search Report issued Sep. 19, 2018 in International (PCT) Application No. PCT/IB2018/053287.

First Office Action and Search Report issued Aug. 4, 2020 in corresponding Chinese patent application No. 201880032234.0 with English translation.

Office Action issued Dec. 15, 2020 in corresponding Japanese Patent Application No. 2019-563233 with English-language translation.

Office Action issued Dec. 17, 2020 in corresponding Korean Patent Application No. 10-2019-7037068 with English- language translation.

* cited by examiner

BENDING MACHINE FOR METAL SHEETS

The invention concerns bending machines arranged to bend and deform metal tapes, sheets, section bar in order to obtain semi-finished and/or finished products. In particular, the invention concerns a bending machine provided with modular and combinable punch and die, made up of respective series of bending tools fixed in a sliding and adjustable way to the upper and lower tool holder crosspieces of the bending machine.

There are known bending machines, also called bending presses, comprising a mechanical or hydraulic action press capable of moving an upper tool, called punch, against a lower tool, called die, on which the workpiece is positioned. The punch applies a force on the piece capable of deforming and bending the latter according to an angle determined on the upper and lower tool configuration.

A type of bending machine comprises a punch made up of a bending blade or knife capable of deforming along a predefined bending line the metallic piece appropriately positioned on a counterposed die provided with a longitudinal seat or grooving intended to interact with the punch in order to bend the piece.

To keep the piece in the correct position on the die during bending, appropriate back gauge devices or back gauges are generally provided. The back gauges comprise respective abutment elements intended to be abutted by the workpieces transversally and/or longitudinally with reference to the bending line in order to accurately define the position of said pieces with respect to the bending tools. The back gauges are also movable, manually or using appropriate actuating means, along three orthogonal directions to position pieces with different shapes and/or dimensions with respect to the tools and according to the bends to be executed.

The bending punch or blade is typically made up of a set of upper bending tools or segments mounted on an upper tool holder crosspiece in order to form a modular and combinable punch. In fact, the number, size (width) and position of the upper tools are selected according to the length of the bend to be executed and/or the dimensions of the workpiece, whereas the type of the tools is selected according to the type of bending (angle, shape).

Similarly, the die can be made up of a set of lower bending tools or segments mounted on a lower tool holder crosspiece, generally fixed, in order to form a modular and combinable die. The number, dimensions (width) and the position of the lower tools correspond to the number, dimensions and position of the upper tools in order to execute a bend of a defined length.

To execute a bend of definite length on a piece, the adjacent tools that have the dimensions (width) such to allow the required length to be precisely obtained must be chosen among the set of tools mounted on the upper and lower crosspieces. Because the tool dimensions are standardised and discretely variable (typically by 10 mm steps), depending on predefined sizes (widths), it is not always possible to execute the required bends with the set of tools currently mounted on the crosspiece. To execute subsequent and different work cycles, it is often necessary to replace, at least partially, the bending tools mounted on the crosspiece.

In the event that several operations or processes must be carried out in order to obtain the product desired from the initial piece (typically making a panel from a flat piece of metal sheet), the initial piece must be transferred sequentially onto several bending machines, for example arranged in a line.

If the piece has small dimensions, all the processes can be carried out on a single bending machine, moving the aforementioned piece through subsequent stations or work areas of the machine in which the bending tools mounted on the same tool holder crosspiece execute the necessary bends. In this case, the bending tools must be appropriately selected and arranged along the crosspiece according to the required composition in the respective different stations in order to execute the subsequent bends.

In this case as well, in order to obtain the various tool compositions needed for a work cycle, the bending tools mounted on the crosspiece must be often replaced, at least partially.

There are known bending tool automatic replacement and mounting systems in bending machines for mounting/disassembling and positioning on the crosspieces the bending tools required for the various processes. The aforementioned systems comprise picking and transferring means that provide to mount tools picked from a tool holder magazine in the desired positions on the crosspieces, typically located inside the machine, behind or on top of the upper crosspiece. The aforementioned picking means also disassemble from the crosspieces the tools to be replaced and insert them in the magazine.

The picking and transferring means comprise external manipulators such as robots or jointed mechanisms which, through rotation and/or transfer movements, insert and pick the tools required in order to achieve the compositions of tools with the required lengths on the crosspieces.

There are also known bending machines in which the back gauge devices are used to replace the upper and lower bending tools.

For example, the document EP 0530375 describes a bending machine in which the back gauge device shows a vertically movable part that is used to replace the tools mounted on the punch and/or on the die of the machine with tools housed in a magazine located inside the machine, behind the punch.

The document WO 2012/151601 describes a bending machine in which the devices for back gauging the pieces are also used to change and replace the tools mounted on the die with tools housed in a rear magazine on specific crosspieces.

A disadvantage of the known bending tool machines lies in the fact that, in order to execute bends of different lengths, they generally require replacement of the tools in order to create compositions of tools with the required lengths. To carry out mounting and/or disassembling operations of the tools (which must be picked and/or put back in the magazine) a considerable time interval is needed during which the machine must be stopped, thereby interrupting production and consequently decreasing the productivity of the machine itself.

Moreover, the replacement and/or positioning of the tools can be carried out only at the beginning of the piece work cycle and not during the cycle itself. In fact, in this case, the cycle would last too long, consequently reducing the productivity of the machine.

Another disadvantage of the known bending machines lies in the cost and complexity of the picking and transferring systems required, not only to replace the bending tools, but also to move them along the crosspieces in order to group them appropriately in number and composition to form bending blades having the required length and arranged along the crosspieces.

The document EP 1658908 illustrates a bending machine in which the back gauge devices are also used to move the tools mounted on a die of the apparatus. In particular, each back gauge supports a respective arm swiveling in a horizontal position in which an extendible section thereof can be extended to engage the tools and move them, individually or in groups, along the crosspiece of the die.

A disadvantage of this solution lies in the fact that the back gauge devices are movable inside the bending machine—in particular in an operating area delimited by side uprights of the machine support structure—and they are unable to reach the bending tools positioned at the end of the crosspiece, outside the operating area; in fact, the crosspiece generally has a longitudinal extension or length greater than that of the bending machine supporting structure. Therefore, specific pushers are needed to move the tools from the ends of the die crosspiece along the latter into the back gauge devices operating area.

One purpose of the present invention is to improve the known bending machines arranged to bend and deform metal tapes, sheets, profiles and, in particular, the bending machines provided with modular and combinable punches and dies made up of a set of bending tools fixed in a sliding way on tool holder crosspieces.

Another purpose is to obtain a bending machine that allows compositions of tools to be achieved in a quick and precise way, minimising machine stop times, in particular allowing lower bending tools of the die to be configured and arranged.

A further purpose is to provide a bending machine with means for the automatic configuration and positioning of the lower bending tools, having a simple and economic structure and with effective and reliable operation.

These purposes and others are achieved by a bending machine according to claim 1. The invention can be better understood and implemented with reference to the accompanying drawings that illustrate an embodiment as non-limiting example, in which:

Figure 1:
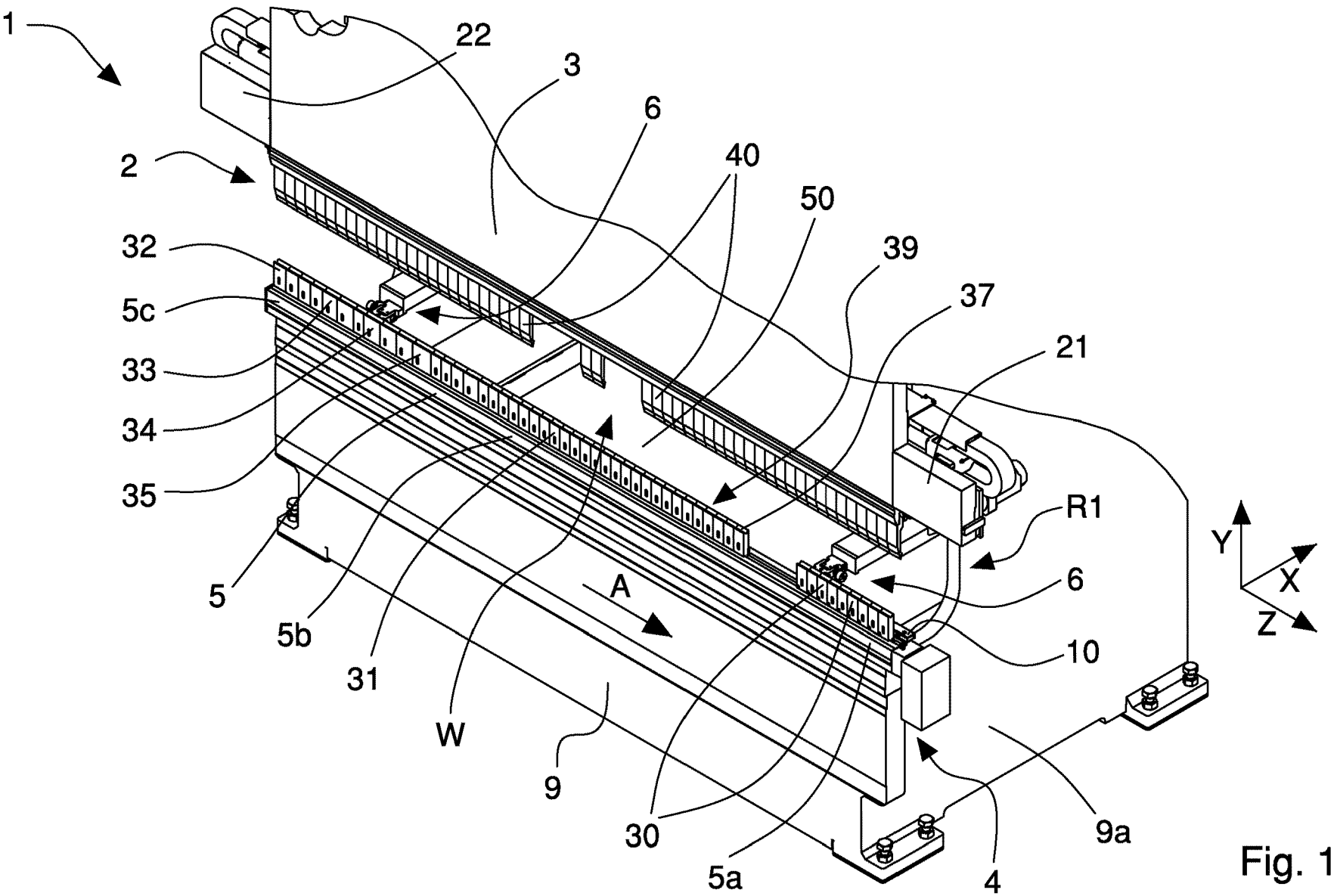
FIG. 1 is a front, schematic view of the bending machine of the invention.
Figure 2:
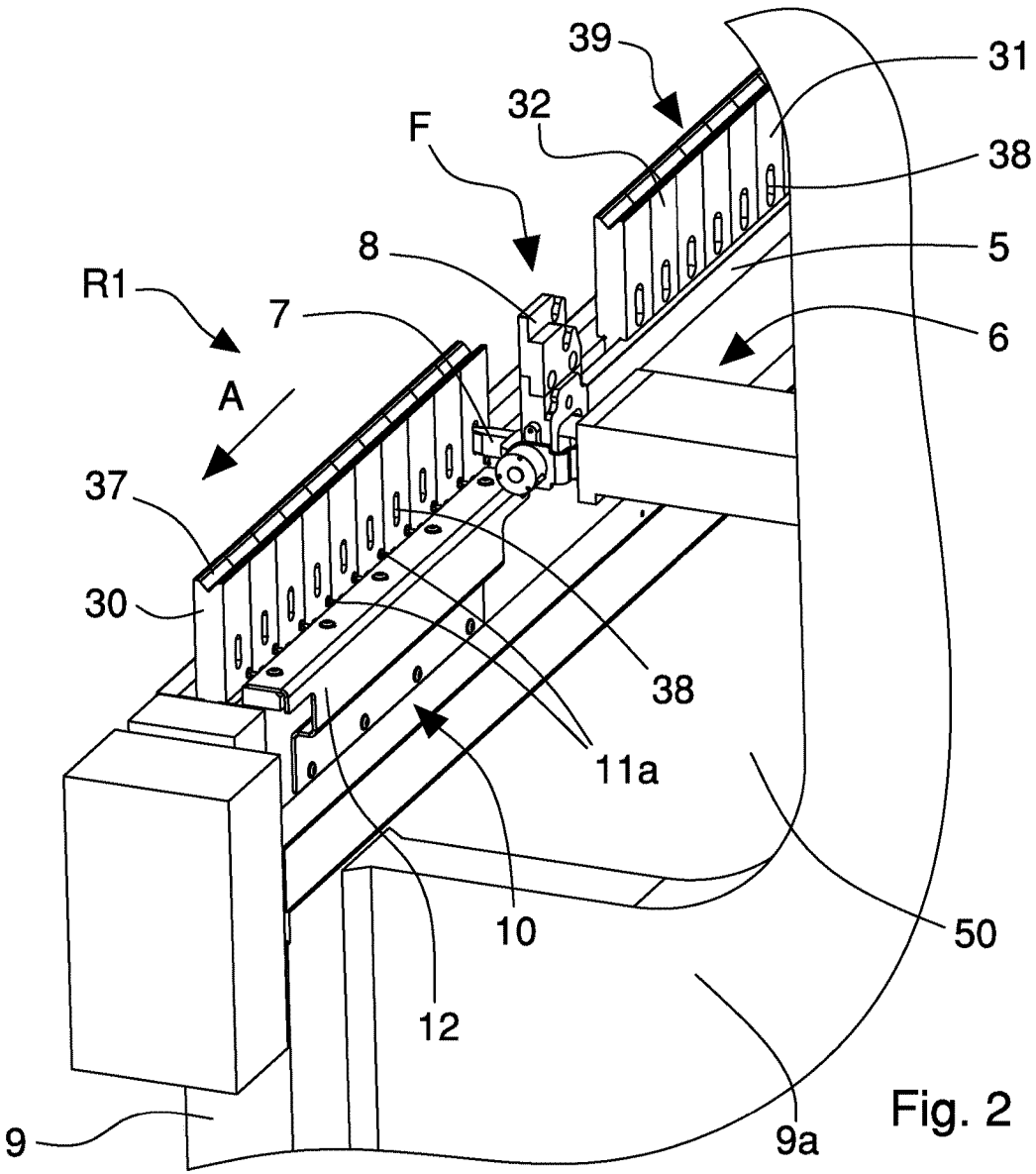
FIG. 2 is a partial and rear view of the bending machine of FIG. 1, that illustrates a set of lower side tools and back gauge units in an operating configuration.

With reference to FIGS. 1 to 10, a bending machine 1 for metal sheets is illustrated in accordance with the invention, that comprises punching means 2 including an upper crosspiece 3 adapted to support a plurality of upper bending tools 40 or more simply upper tools 40, so-called bending blades or segments, mounted aligned, adjacent and reciprocally positionable along a longitudinal bending direction A so as to form definite compositions of upper tools.

The aforementioned bending tools 40 form a modular and combinable punch that is sliding and adjustable along the upper crosspiece 3 of the bending machine 1.

The bending machine 1 also comprises die means 4 that include a lower crosspiece 5 adapted to support a plurality of lower bending tools 30-35 or more simply lower tools 30-35 aligned, adjacent and mutually positionable along the bending direction A so as to form respective compositions of lower tools.

The lower bending tools 30-35 thereby form a modular and combinable punch that is sliding and adjustable along the lower crosspiece 5 of the bending machine 1.

The compositions of upper and lower tools are arranged to bend a workpiece according to respective defined bending lines. The bending direction A is parallel to the bending line carried out on the piece.

The bending machine 1 includes a frame 9 intended to support the upper crosspiece 3 of the punching means 2 and the lower crosspiece 5 of the die means 4. In particular, the upper crosspiece 3 that comprises a substantially vertical plate parallel to the bending direction A is movable, actuated by mechanical and/or hydraulic actuators, of a known type and not illustrated in the figures, along a direction transversal to the bending direction A and substantially vertical.

Alternatively, the upper crosspiece 3 can be moved according to an arched motion trajectory, for example pivoted to the frame 3 according to a horizontal axis parallel to the bending direction A.

In the embodiment illustrated in the figures, the upper crosspiece 3 is overlapped and aligned with the lower crosspiece 5 and movable from the top downward to interact and therefore bend a workpiece.

To increase productivity and operational flexibility of the bending machine 1 the length of the upper 3 and lower 5 crosspieces is greater than the width of the machine frame 3, in other words end portions of the crosspieces 3, 5 protrude laterally from the dimensions defined by the aforementioned frame 9.

The bending machine 1 comprises at least one movable back gauge unit 6 arranged to abut and position a workpiece with respect to the die means 4, in particular through a respective abutment element 8.

The back gauge unit 6 also includes a hooking element 7 arranged to selectively engage one of the lower tools 30-35 in order to move the latter and/or the lower tools adjacent to it along the bending direction A on the lower crosspiece 5.

In the illustrated embodiment, the bending machine 1 comprises two back gauge units 6 movable inside an operating area W in a compartment 50 made up of side walls 9*a* and a rear wall of the frame 9.

Each back gauge unit 6 is movable inside the operating area W along three orthogonal axes X, Y, Z of motion, one of which, for example a third axis Z, is parallel to the bending direction A. The back gauge unit 6 is moved along the three orthogonal axes X, Y, Z through conveying means of a known type and not illustrated in the figures.

Due to the structure of the frame 9, the movements of the back gauge units 6 along the third axis Z are therefore delimited by the side walls 9*a* inside the compartment 50. In other words, the back gauge units 6 can be moved only inside the operating area W, and in particular along and at a central portion 5*b* of the lower crosspiece 5 inside of said operating area W, facing the compartment 50.

The plurality of lower tools 30-35 arranged on the lower crosspiece 5 comprises at least one set of side lower bending tools 30 that can be positioned in a respective non-operative configuration R1 even at one of the end portions 5*a*, 5*c* of the lower crosspiece 5 protruding laterally from the frame 9 of the machine 1, outside the operating area W and in any case unreachable by the back gauge unit 6.

The side lower tools 30 are positioned in the respective non-operative configuration R1 on one of the end portions 5*a*, 5*c* of the lower crosspiece 5 when they are not used in the operations for bending the piece.

The side lower tools 30 are reversibly connectable to one another in order to form a group or convoy G of side lower tools 30 selectable in number which at least one, the innermost one, even in the non-operative configuration R1 remains positioned inside the operating area W and therefore can be reached and engaged by the hooking element 7 of one of the two back gauge units 6, in particular the most adjacent one. This way, the aforementioned side lower tool 30 can be moved by the back gauge unit 6 together with the convoy G along the bending direction A.

In the illustrated embodiment, the side lower tools 30 can be positioned in the non-operative configuration R1 in the right end position 5*a*, with reference to the view of FIG. 1. More precisely, lower tools with different sizes can be mounted on the lower crosspiece 5 in order to achieve a plurality of different compositions of tools having respective lengths to carry out corresponding bends on the piece, in cooperation with the compositions of upper tools 40.

In the example illustrated in the figure, in addition to the side lower tools 30, all having the same size, first central lower tools 31, second central lower tools 32, third central lower tools 33, fourth central lower tools 34, fifth central lower tools 35 having different and increasing dimensions (width), are also mounted on the lower crosspiece 5 to form the modular die.

It is also possible to provide a set of side lower tools on the lower crosspiece 5 with different dimensions and conveniently located and positioned to one another to form different groups of side lower tools with different bending lengths.

On the upper crosspiece 3, on the other hand, a plurality of upper tools 40 identical to one another is mounted to form the modular punch. Nevertheless, it is also possible to mount on the upper crosspiece 3 upper tools with different sizes and with appropriate placement and distribution in order to achieve a plurality of different compositions of tools having respective bending lengths.

Figure 6:
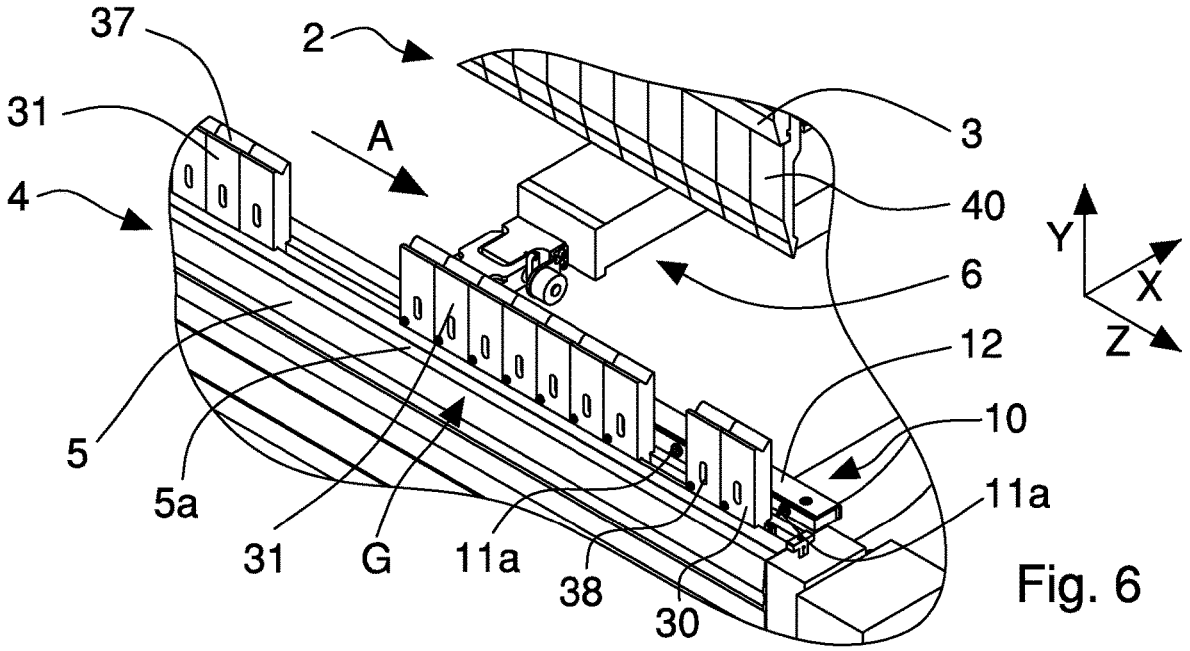
FIG. 6 is an enlarged and partial view of the machine of FIG. 1 that illustrates a group of side lower bending tools moved by the back gauge unit.

Each side lower tool 30 comprises connecting means 15, 16 to engage or disengage respective connecting means 15, 16 of an adjacent side lower tool 30 in order to connect or disconnect the adjacent side lower tools 30 to one another and form a convoy G of side lower tools 30 (FIG. 6).

The bending machine 1 has actuating means 10 acting selectively on the connecting means 15, 16 of the side lower tools 30 to mutually engage or disengage the connecting means 15, 16 and thereby allow the respective side lower tools 30 to be connected or disconnected. The actuating means 10 are fixed to the lower crosspiece 5 at its end portion 5*a* (right) on which the side lower tools 40 can be moved.

Figure 7:
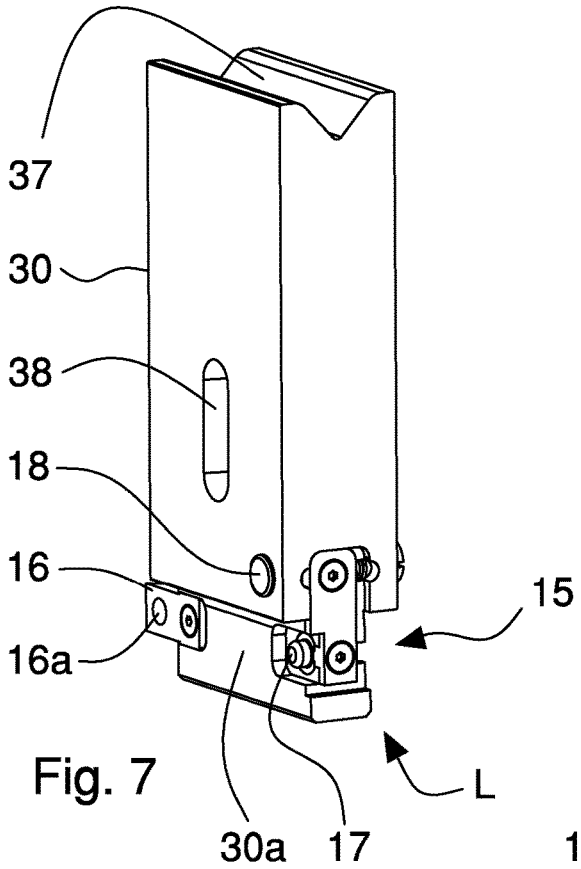
FIG. 7 is an enlarged prospective view of a side lower tool provided with connecting means.
Figure 8:
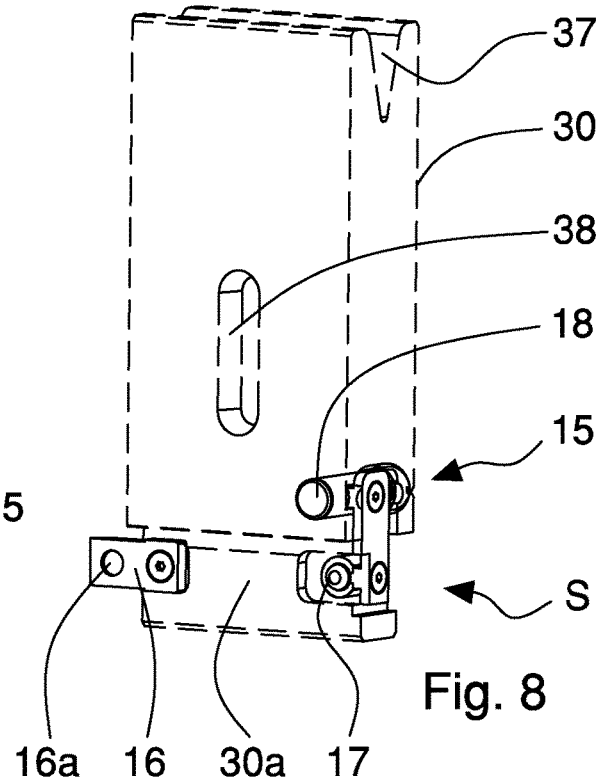
FIG. 8 is another enlarged prospective view of the side lower tool illustrated in a dashed line to better highlight the connecting means.
Figure 9:
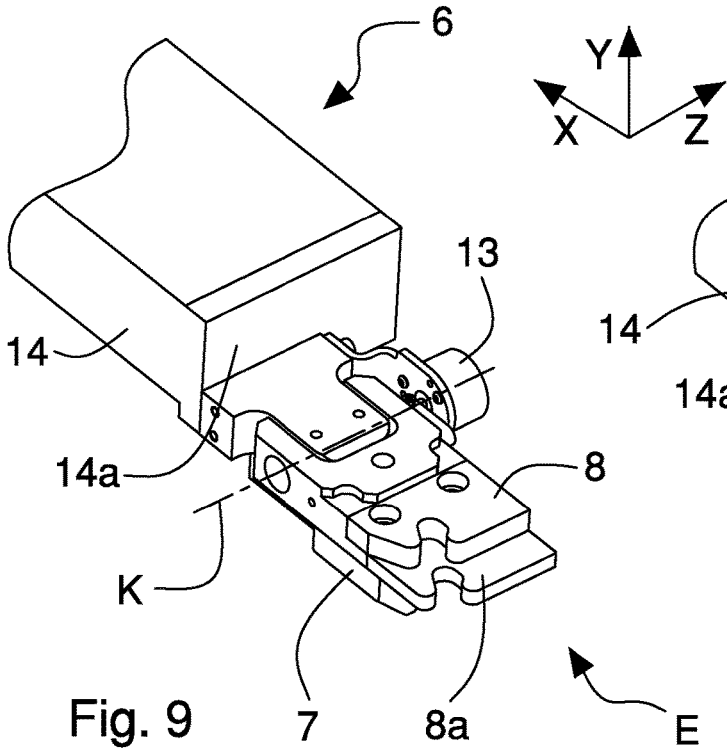
FIGS. 9 and 10 are partial and enlarged prospective views of the back gauge unit with an abutment element respectively in an operating position and a non-operating position.
Figure 10:
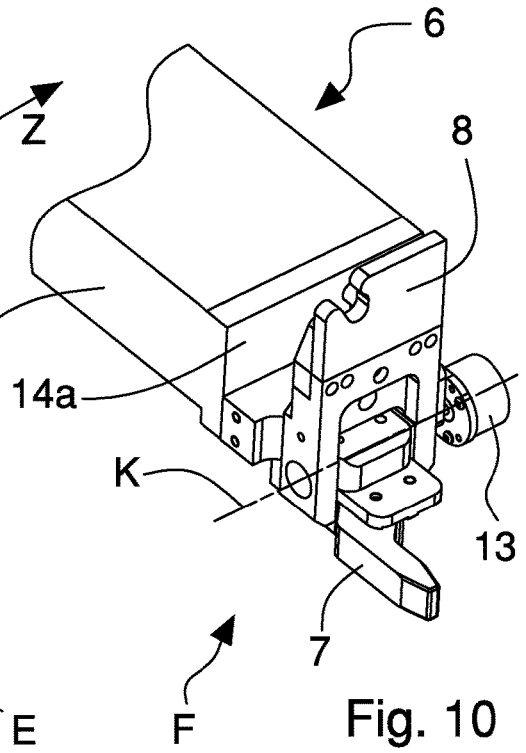

With particular reference to FIGS. 7 and 8, the connecting means of each side lower tool 30 comprises a first connecting element 15 and a second connecting element 16 fixed on opposite sides of a respective side lower tool 30. The first connecting element 15 is movable by actuating means 10 between a hooking position L and a releasing position S respectively to engage or disengage a second connecting element 16 of an adjacent side lower bending tool 30.

More in particular, the first connecting element 15 comprises a connecting pin 17 that is slidably mounted on the respective side lower tool 30 and movable, in particular transversally to the bending direction A, so as to protrude in the hooking position L from a rear face 30*a* of the side lower tool 30. The second connecting element 16 is fixed to the rear face 30*a*, laterally protruding from the opposite side with respect to the first connecting element 15, and provided with a seat 16*a* adapted to receive the connecting pin 17 of a first connecting element 15 of an adjacent side lower tool 30.

The actuating means 10 comprise a plurality of actuating cylinders 11 positioned adjacent to the lower crosspiece 5, at the right end portion 5*a* of the latter. Each of the actuating cylinders 11 is arranged to actuate and move the first connecting element 15 of a respective side lower tool 30 in order to move said first connecting element 15 between the hooking position L and the releasing position S.

The actuating cylinders 11 are arranged regularly spaced apart from one another along the bending direction A and are equal in number to that of the side lower tools 30. The actuating cylinders 11 are controlled by a control unit of the bending machine 1.

The actuating means 10 also comprise a supporting element 12, for example an elongated and moulded element arranged to support the actuating cylinders 11 and fixed to the right end portion 5*a* of the lower crosspiece 5.

The first connecting element 15 comprises, in addition to the connecting pin 17, a actuating pin 18 slidably mounted and connected to the connecting pin 17 in order to slide integrally with the latter transversally to the bending direction A. The actuating pin 18 protrudes from the lower face 30*a* of the side lower tool 30 in order to be abutted by a stem 11*a* of a respective actuating cylinder 11. The latter, when activated by the control unit of the bending machine 1 is therefore able to move the actuating pin 18, and therefore the connecting pin 17 connected to it, between the hooking position L and the releasing position S.

In the embodiment described, elastic means, not illustrated, are inserted in the side lower tool 30 to maintain the connecting pin 17 protruding from the lower face 30*a* in the hooking position L. The elastic means can act directly on the connecting pin 17 or on the actuating pin 18. This way, when the actuating cylinders 11 are not activated (in other words the stems 11*a* do not act on the actuating pins 18), the connecting pins 17 are engaged with the second connecting element 16 of the adjacent side lower tools 30, the latter ones being reciprocally connected to one another.

The lower tools 30-35 comprise respective hooking cavities 38, for example made on the rear faces of the aforementioned lower tools, arranged to receive and be engaged by the hooking element 7 of one of the back gauge units 6.

Each back gauge unit 6 is provided with the abutment element 8 that is adjacent to the hooking element 7 and movable between an operating position E, in which the abutment element 8 is arranged in such a way so as to abut a workpiece with one of its shaped ends 8*a*, and a non-operating position F in which said abutment element 8 allows the hooking element 7 to engage an established lower tool 30-35. More precisely and in the illustrated embodiment, the hooking element 7 is fixed and connected to an end 14*a* of a main body 14 of the back gauge unit 6, while the abutment element 8 is rotatably fixed on said end 14*a* of the main body 14 in order to rotate about a rotation axis K parallel to the first axis X and the bending direction A. This way, the abutment element 8 is moved by a respective rotating motor 13, for example pneumatic or electric, between the operating position E, where it is arranged substantially horizontally, overlapped on the hooking element 7 in order to abut the piece, and the non-operating position F, where said abutment element 8 is rotated about 90° upward in an almost vertical position to allow the hooking element 7 to interact with a lower tool 30-35.

As illustrated in the figures, each lower tool 30-35 comprises in its upper portion a longitudinal seat or cavity 37 that is substantially "V"-shaped. In a composition of lower tools 30-35, the adjacent and aligned longitudinal seats 37 form a longitudinal groove 39 with a transversal "V"-shaped section, parallel to the bending direction A and having a length defined by the pre-selected composition of lower tools 30-35. The longitudinal groove 39 of the die means 4 cooperates with the upper tools 40, also grouped in a composition of appropriate length to form the bending blade of the punching means 2 to carry out bends on the piece.

Shape and dimension of the longitudinal seat 37, in particular its transversal "V"-shaped section, are determined and selected as a function of the type of work to be done on the pieces and of the shape and dimensions of the latter.

To change shape and section of the longitudinal seat 37 and therefore of the longitudinal groove 39, the lower bending tools 30-35 must be replaced.

In a variation of the bending machine 1 not illustrated in the figures, each lower tool can be the adjustable type and comprise a body, the upper portion thereof is constituted by two opposite and substantially symmetric parts that form the longitudinal "V"-shaped seat. The two opposite parts can be moved with respect to each other farther apart or closer together in order to allow the shape and transversal dimensions of the aforementioned V-shaped longitudinal seat to be changed. By appropriately adjusting the distance of the two opposite parts of each of the lower tools that constitute a desired composition of tools, it is therefore possible to change shape and transversal dimensions of the longitudinal groove that cooperates with the upper tools 40 of the punching means 2 to achieve different types of bends.

This variation of the bending machine 1 of the invention allows compositions of tools with different bending lengths and different sizes of the longitudinal groove to be achieved. The bending machine 1 comprises locking means, of a known type not illustrated in the figures, which are associated with the lower crosspiece 5 and arranged to lock the lower tools 30-35 to the latter at least during a bending phase of the workpiece in order to prevent it from accidentally shifting along the bending direction A.

Figure 3:
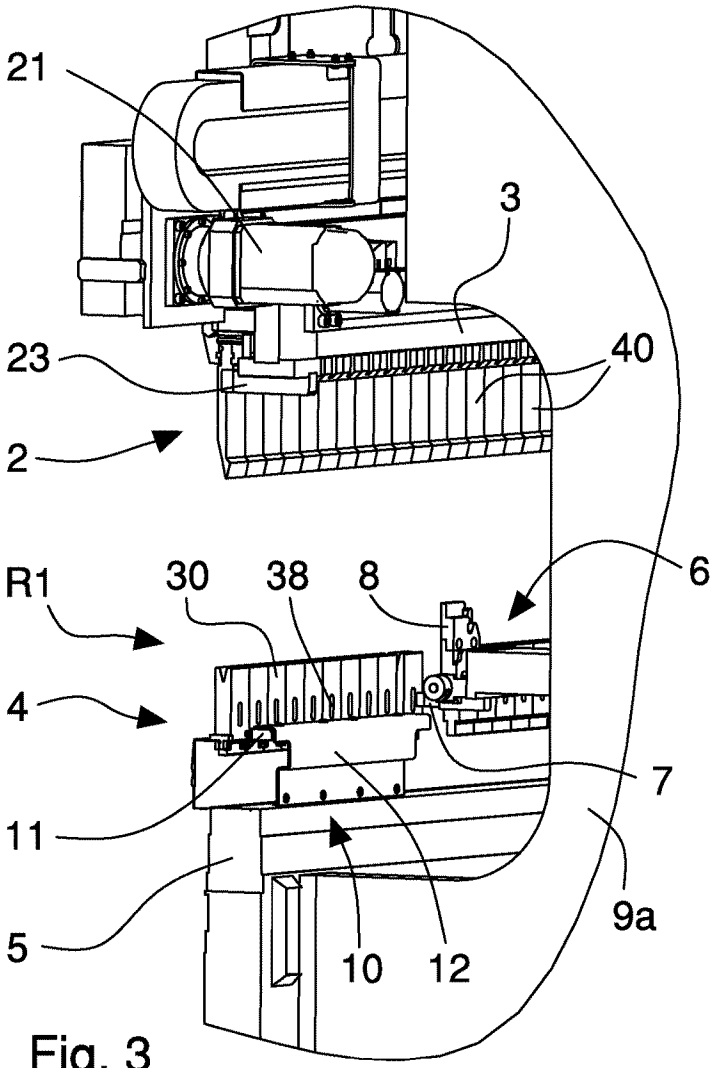
FIG. 3 is another partial and rear view of the bending machine of FIG. 1 that illustrates the set of lower side bending tools, the back gauge unit and upper bending tool driving means.
Figure 4:
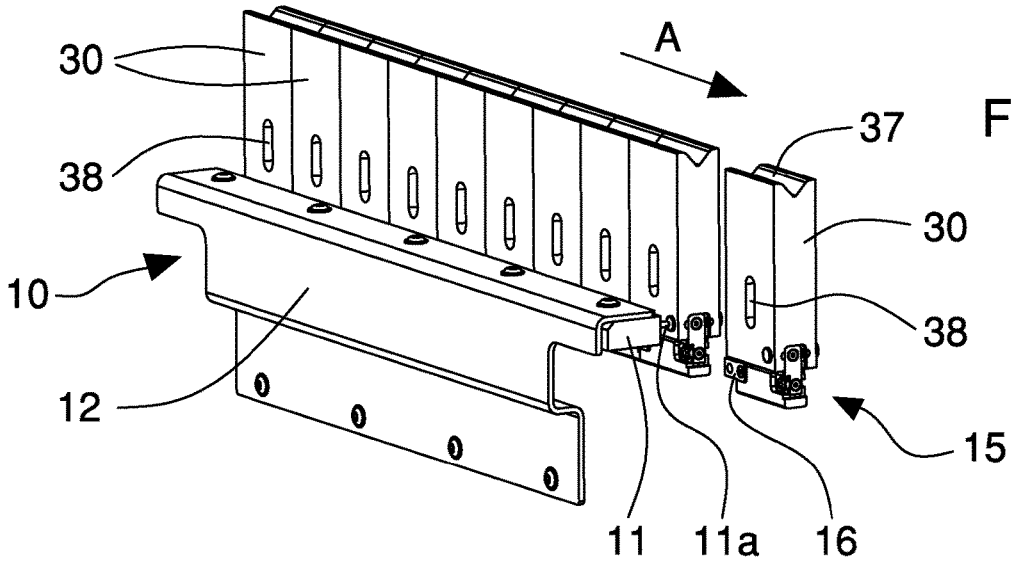
FIGS. 4 and 5 are enlarged prospective views of the set of lower side tools fitted with connecting means and associated with actuating means in two different operating configurations.
Figure 5:
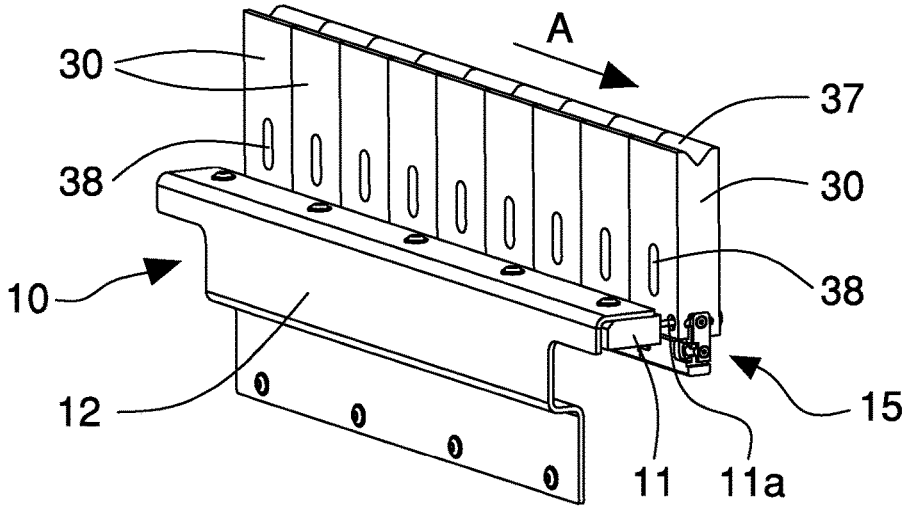

With particular reference to FIG. 3, in the illustrated embodiment the bending machine 1 of the invention comprises driving means 21, 22 associated with the punching means 2 and arranged to move the upper bending tools 40 along the bending direction A on the upper crosspiece 3. The position of the driving means is controlled by the control unit of the bending machine 1 and comprise, for example, a first carriage 21 and a second carriage 22, both movable along the upper crosspiece 3 along the bending direction A. Each carriage 21, 22 is provided with respective retrieval means 23 capable of hooking or engaging a defined upper tool 40 and moving it together with one or more upper tools 40 adjacent to it, along the bending direction A.

Operation of the invention bending machine 1 envisages a tool configuration phase needed to arrange on the crosspieces 3, 5 of the punching means 2 and die means 4 the compositions of upper and lower tools needed to carry out the bend of the desired length on the piece.

For this purpose, the locking means that fasten the lower bending tools 30-35 to a guiding longitudinal groove made in the lower crosspiece 5 are disabled in order to allow the lower tools 30-35 to freely slide along the latter. At least one of the back gauge units 6 with the abutment element 8 rotated in the non-operating position F is moved to engage a defined lower tool 30-35, inserting the hooking element 7 in the corresponding hooking cavity 38. In this way, the back gauge unit 6 is able to move the lower tool 30 and/or a plurality of lower tools 30 adjacent to it along the bending direction A on the lower crosspiece 3. More precisely, by moving the lower tool 30 engaged by the hooking element 7 of the back gauge unit 6 toward the right (with reference to the view of FIG. 1), all the adjacent lower tools located to the right of the aforementioned lower tool 30 can also be moved. Similarly, by moving the lower tool 30 engaged by the hooking element 7 toward the left, all the adjacent lower tools located to the left of the aforementioned lower tool 30 can also be moved together with it.

The back gauge unit 6 is able to engage and move all the lower tools 30-35 that are in a central portion 5*b* of the lower crosspiece 5 facing the compartment 50, that is in the operating area W. In particular, the back gauge unit 6 is capable of engaging and moving all the central lower tools 31-35 even with different sizes and that can be moved along the central portion 5*b* of the lower crosspiece 5.

Thanks to the connecting means 15, 16 which the side lower tools 30 are provided with, the back gauge unit 6 is also able to move one or more side lower tools 30 of the set of side lower tools 30 even when the latter ones are positioned in one of the end portions 5*a*, 5*c* of the lower crosspiece 5 unreachable directly by the back gauge unit 6.

For this purpose, the back gauge unit 6 engages and hooks with the hooking element 7*a* first side lower tool 30 of the set that is adjacent to the central portion 5*b* of the lower crosspiece 5 and inside the operating area W. The aforementioned first side lower tool 30 is connected to the adjacent side lower tools 30 (located on its right with reference to the view in FIG. 1) through the connecting means 15, 16. In a non-operative configuration in which the actuating means 10 are not activated by the control unit of the bending machine 1, the connecting pins 17 of the first connecting elements 15 are, in fact, in the hooking position L, engaged in the second connecting elements 16. In this configuration, by moving the first side lower tool 30, the entire set of side lower tools 30 is moved from the back gauge unit 6 along the lower crosspiece 5.

By activating a determined actuating cylinder 11, it is nevertheless possible to disengage the connecting means 15, 16 of the corresponding side lower tool 30 in order to separate the latter from the adjacent side lower tool 30.

As illustrated in FIG. 6, the operation of the actuating cylinder 11 (for example the second actuating cylinder 11 from the right with reference to FIG. 1) allows the actuating pin 18 and therefore the connecting pin 17 connected to it to be moved from the hooking position L and to the releasing position S in which said connecting pin 17 is disengaged from the second connecting element 16 by the adjacent side lower tool 30, that is by the tool located on the left with reference to FIG. 1 (the third side lower tool 30 from the right). This way, the side lower tool 30 the drive pin 18 of which is engaged by the corresponding actuating cylinder 11 and all the adjacent side lower tools 30 that may be on its right cannot be moved by the back gauge unit 6 and remain stopped on the end portion 5*a* of the lower crosspiece 5. The convoy G of side lower tools 30 that can be moved by the back gauge unit 6 on the lower crosspiece 5 is therefore made up of the side lower tool 30 engaged by the hooking element 7 of the back gauge unit and the side lower tools 30 connected to it and located on the left of the side lower tool the drive pin 18 of which is occupied by the corresponding actuating cylinder 11.

By appropriately selecting the actuating cylinder 11 of the actuating means 10 according to the work needs, it is therefore possible to select the number of side lower tools 30 that form the convoy G to be moved by the back gauge unit 6 along the lower crosspiece 5 to realize one or more compositions of tools with or without the central lower tools 31-35.

Thanks to the back gauge units 6 and the side lower tools 30 provided with respective connecting means 15, 16, it is therefore possible to form on the lower crosspiece 5 of the die means 4 a desired composition of lower tools 30-35, suitable and complementary to a respective composition of upper tools 40 selected and moved on the upper crosspiece 3 of the punching means 2 by the driving means 21, 22.

The same back gauge units 6 move the not used side lower tools 30 and/or central lower tools 31-35 on portions, for example end portions, of the lower crosspiece 5 that are not used during the bending process.

Two or more compositions of lower tools 30-35 can be arranged on the lower crosspiece 5 to carry out respective subsequent bending operations in sequence on the same piece in order to obtain the final product cooperating with two or more corresponding compositions of upper tools 40 arranged on the upper crosspiece 3.

The bending machine 1 of the invention, by using the back gauge unit 6, allows you to select and place as desired, according to production needs, the lower bending tools 30-35 mounted on the lower crosspiece 5. Therefore, unlike known bending machines, dedicated hooking and driving means, comprising external manipulators such as robots or articulated hooking mechanisms, are not required to create compositions of tools with the required lengths on the lower crosspiece 5.

It is therefore possible to simplify the structure of the bending machine 1 of the invention and to make it more economic. Furthermore, the back gauge units movable along the three axes X, Y, Z allow the lower bending tools 30-35 needed for the required processing to be arranged more quickly and more precisely, minimising the machine down times, in other words speeding up the piece processing cycle time.

It should be noted that by means of the lower bending tools 30-35 mounted on the lower crosspiece 5, it is possible to create, in cooperation with the upper bending tools 40 mounted on the upper crosspiece 3, a plurality of bends with variable lengths, without the need to replace the tools. In fact, by appropriately separating and grouping the lower and upper tools with different sizes and dimensions and with appropriate placement on the crosspieces 3, 5, it is possible to create all the compositions of tools needed to execute the different bending lengths, simply separating the selected tools (always adjacent to one another) from the remaining tools, without the need to mount/disassemble the aforementioned tools from the crosspieces 3, 5.

The bending machine 1 of the invention therefore offers high operating flexibility and allows optimisation of the piece processing cycles.

In a variation of the bending machine 1 of the invention, not illustrated in the figures, the plurality of lower tools 30 comprises two sets of side lower tools 30 that can slide on the lower crosspiece 5 and be arranged at its two end portions 5*a*, 5*b* in respective non-operative configurations. The side lower tools 30 of each set can be connected to one another in order to form a respective convoy G of side lower tools 30 selectable in number and movable along the bending direction A by a respective back gauge unit 6 to form, even in cooperation with one or more central lower tools 31-35, a desired composition of lower bending tools.

Respective actuating means 10 are provided at both end portions 5*a*, 5*b* of the lower crosspiece 5 to act selectively on the connecting means 15, 16 of the side lower tools 30 of the two sets of side lower tools to mutually engage or disengage the connecting means 15, 16 and allow the respective side lower tools 30 to be connected or disconnected.

The operation of this version of the bending machine 1 of the invention is substantially identical to that of the machine in the form described above and illustrated in the figures. In this case, the compositions of lower tools 30-35 to be used to bend the piece can be made up of, in addition to the central lower tools 31-35, side lower tools 30 of the two sets of side lower tools arranged on the two opposite end portions 5*a*, 5*b* of the lower crosspiece 5. Each back gauge unit 6 provides for picking and moving a respective convoy G of side lower tools 30 formed by hooking a defined number of side lower tools of the set to one another.

Figure 11:
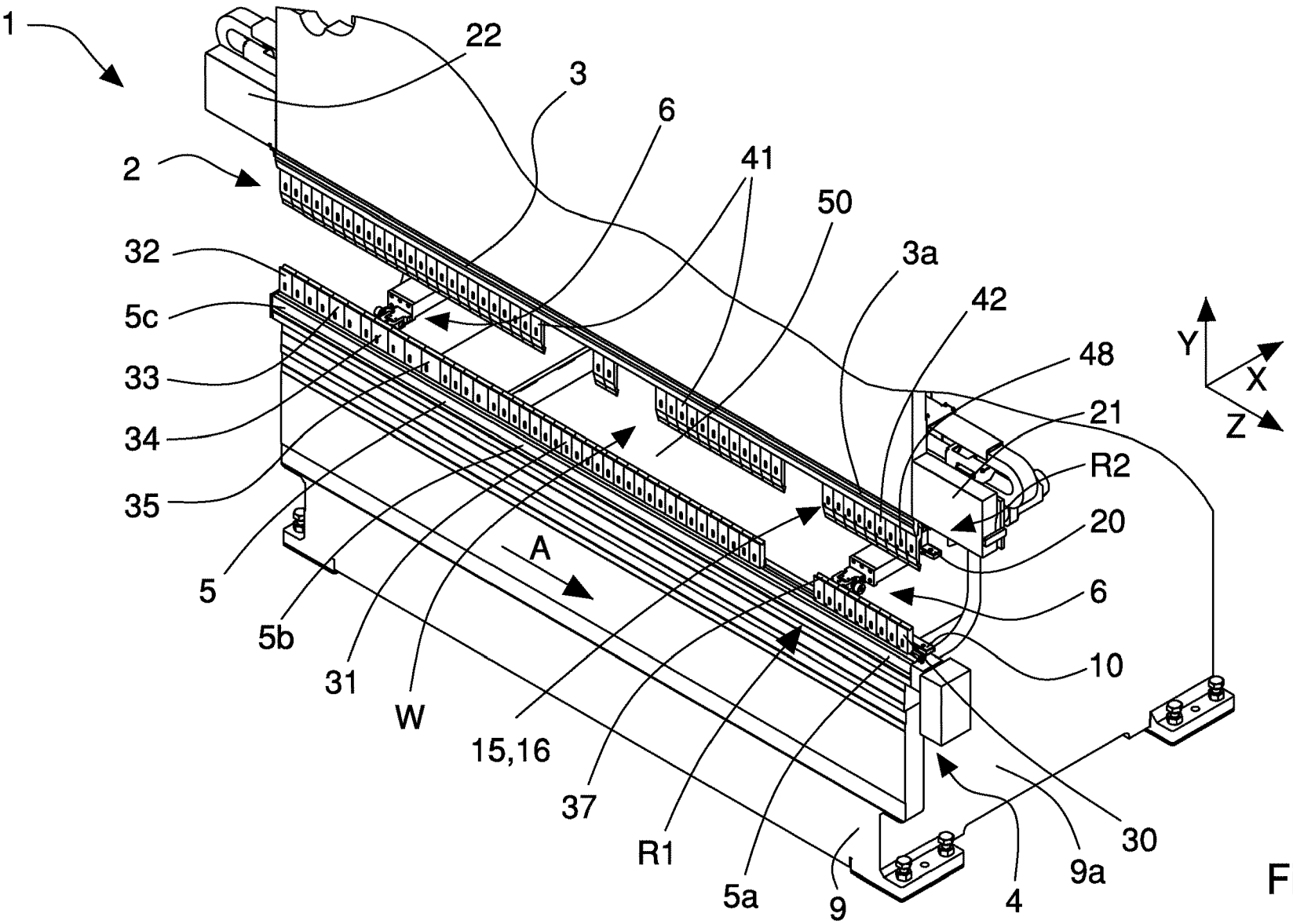
FIG. 11 is a front, schematic view of a variation of the bending machine of the invention.

With reference to FIG. 11, another variation of the bending machine 1 of the invention is illustrated, in which the back gauge units 6 are also arranged to engage and move the upper bending tools 41, 42 along the upper crosspiece 3 of the punching means 2 in substitution of the driving means 21, 22. For this purpose, the upper tools 41, 42 comprise respective hooking cavities 48 arranged to receive and be engaged by the hooking element 7 of one of the back gauge units 6, in order to be moved by the latter along the upper crosspiece 3. In this version of the bending machine, it is also envisaged that the plurality of upper bending tools 41, 42 should comprise a set of central upper tools 41 and at least one respective set of side upper tools 42 that can be positioned in a respective non-operative configuration R2 at an end portion 3*a* of the upper crosspiece 3 protruding from the frame 9 and outside the operating area W and therefore unreachable by the back gauge unit 6. The side upper bending tools 42 are positioned in the respective non-operative configuration R2 on the end portion 3*a* of the upper crosspiece 3 (for example the one on the right with reference to the view in FIG. 11) when they are not used in the bending of the piece.

The side upper bending tools 42 are reversibly connectable to one other so as to form a respective group of side upper bending tools 42 selectable in number of which at least one, the innermost one, remains positioned inside the operating area W even in the non-operative configuration R2 and therefore reachable and usable by the hooking element 7 of one of the two back gauge units 6, in particular the most adjacent one. This way, the aforementioned side upper tool 42 can be moved by the back gauge unit 6 together with the respective group along the bending direction A on the upper crosspiece 3.

In this case as well, each side upper tool 42 comprises respective connecting means 15, 16 to engage or disengage respective connecting means 15, 16 of an adjacent side upper tool 42 in order to connect or disconnect the aforementioned adjacent side upper tools 42 to one another and form the convoy of side upper tools 42.

The connecting means 15, 16 are identical to the connecting means 15, 16 of the side lower tools 30 described above and illustrated in the figures.

Similarly, further actuating means 20 are associated to the upper crosspiece 3 to act selectively on the connecting means 15, 16 of the side upper tools 42 to mutually engage or disengage the connecting means 15, 16 and to thereby allow the respective side upper tools 42 to be connected or disconnected.

The further actuating means 20 associated with the upper crosspiece 3 are identical to the actuating means 10 associated with the lower crosspiece 5 and acting on the side lower tools 30.

In the embodiment illustrated, the central upper tools 41 and the side upper tools 42 have the same dimensions. On the upper crosspiece 3 of the punching means 2 it is nevertheless possible to provide central and/or side upper tools with different dimensions and appropriately located and positioned to one another to form different compositions of upper tools with different bending lengths.

Operation of this variation of the bending machine 1 of the invention is substantially identical to that of the machine in the embodiment described above and illustrated in the figures since the procedure for selecting and moving a group of side upper tools 42 selected in the set of side upper tools on the upper crosspiece 3 of the punching means 2 is identical to that described for the side lower tools 30 of the die means 4.

It is therefore possible in this version of the bending machine 1 of the invention to advantageously use the back gauge units 6 to select and move both the lower tools 30-35 placed on the lower crosspiece 5 and the upper tools 41, 42 placed on the upper crosspiece 3. The structure of the bending machine 1 is simplified and more economical since dedicated driving means (carriages 21, 22 with respective connecting means 23) to be mounted on the upper crosspiece 3 to select and move the upper bending tools 41, 42 are no longer necessary.

It should be noted that in this version of the bending machine 1 as well, thanks to the side upper tools 42 selectively and reversibly connectable with one another through the respective connecting means 15, 16 in order to form a group of desired number of tools, it is possible to select and move all the upper tools 41, 42 mounted on the upper crosspiece 3 by means of the back gauge unit 6.

The invention claimed is:

1. A bending machine for metal sheets, the bending machine comprising:

a punching arrangement including an upper crosspiece supporting a plurality of upper bending tools aligned and reciprocally positionable along a longitudinal bending direction so as to form definite compositions of upper bending tools;

a die arrangement including a lower crosspiece supporting a plurality of lower bending tools aligned and mutually positionable along the longitudinal bending direction so as to form respective compositions of lower bending tools;

at least one back gauge unit that is movable inside an operating area of said bending machine and arranged to abut and position a workpiece with respect to said die arrangement, wherein said at least one back gauge unit comprises a hooking element arranged to engage at least one lower bending tool in order to move said at least one lower bending tool along the longitudinal bending direction on said lower crosspiece; and an actuating system, wherein said plurality of lower bending tools comprises at least one set of side lower bending tools that can be positioned, when not being used to bend the workpiece, in a respective non-operative configuration at an end portion of said lower crosspiece where a number of said side lower bending tools are positioned outside of the operating area and are unreachable by said back gauge unit, wherein said side lower bending tools can be selectively connected to and disconnected from one another in order to form a convoy selectable in number of side lower bending tools, wherein at least an innermost side lower bending tool of said side lower bending tools of said convoy positioned in the non-operative configuration is inside the operating area so that said innermost side lower bending tool can be engaged by said hooking element of said back gauge unit and moved by said back gauge unit along the longitudinal bending direction together with said convoy of side lower bending tools, wherein each side lower bending tool comprises a connecting assembly to engage or disengage a respective connecting assembly of an adjacent side lower bending tool in order to connect or disconnect adjacent side lower bending tools from one another and form said convoy of side lower bending tools, wherein said actuating system acts selectively on said connecting assemblies of said side lower bending tools to mutually engage or disengage said connecting assemblies and allow respective side lower bending tools to be connected or disconnected, wherein each of said connecting assemblies comprises a first connecting element and a second connecting element fixed on opposite sides of a respective side lower bending tool, and wherein said first connecting element is movable by said actuating system between a hooking position and a releasing position respectively to engage or disengage said second connecting element of an adjacent side lower bending tool, and wherein said actuating system comprises a plurality of actuating cylinders positioned adjacent to said lower crosspiece, and wherein each actuating cylinder is arranged to move said first connecting element of a respective side lower bending tool in order to move said first connecting element between the hooking position and the releasing position.

2. The bending machine according to claim 1, wherein, for each of said connecting assemblies, said first connecting element comprises a connecting pin that is slidably mounted on said respective side lower bending tool and movable so as to protrude to the hooking position from a rear face of said respective side lower bending tool, and wherein said second connecting element is fixed to said rear face, laterally protrudes and is provided with a seat adapted to receive said connecting pin of said first connecting element of an adjacent side lower bending tool.

3. The bending machine according to claim 2, wherein said actuating system comprises a plurality of actuating cylinders positioned adjacent to said lower crosspiece, and wherein each actuating cylinder is arranged to move said first connecting element of a respective side lower bending tool in order to move said first connecting element between the hooking position and the releasing position.

4. The bending machine according to claim 3, wherein said actuating cylinders are arranged regularly spaced apart from one another along the longitudinal bending direction and are equal in number to that of said side lower bending tools.

5. The bending machine according to claim 1, wherein said actuating cylinders are arranged regularly spaced apart from one another along the longitudinal bending direction and are equal in number to that of said side lower bending tools.

6. The bending machine according to claim 1, wherein said lower bending tools comprise respective hooking cavities, arranged to receive, and be engaged by, said hooking element of said at least one back gauge unit.

7. The bending machine according to claim 1, wherein said at least one back gauge unit comprises an abutment element adjacent to said hooking element and movable between an operating position in which said abutment element is arranged so that one end of said abutment element abuts the workpiece, and a non-operating position in which said abutment element allows said hooking element to engage one of said lower bending tools.

8. The bending machine according to claim 1, wherein said at least one back gauge unit is movable inside the operating area along three orthogonal axes of motion, and wherein one of the three orthogonal axes is parallel to the longitudinal bending direction.

9. The bending machine according to claim 1, further comprising a driving system to move said upper bending tools along the longitudinal bending direction on said upper crosspiece.

10. The bending machine according to claim 1, wherein said upper bending tools comprise respective hooking cavities arranged to receive, and be engaged by, said hooking element of said at least one back gauge unit, and wherein said back gauge unit is arranged to move said upper bending tools along said upper crosspiece of said punching arrangement.

11. The bending machine according to claim 10, wherein said plurality of upper bending tools comprises at least one respective set of side upper bending tools that can be positioned, when not being used in operation for bending the workpiece, in a respective non-operative configuration at an end portion of said upper crosspiece where a number of said side upper bending tools are positioned outside of the operating area and are unreachable by said back gauge unit, wherein said side upper bending tools can be reversibly connected to one another so as to form a respective convoy of side upper bending tools selectable in number, and wherein at least an innermost side upper bending tool of said side upper bending tools of said respective convoy positioned in the respective non-operative configuration is inside the operating area so that said innermost side upper bending tool can be engaged by said hooking element of said back gauge unit and moved by said back gauge unit along the longitudinal bending direction together with said respective convoy of side upper bending tools.

12. The bending machine according to claim 11, wherein each side upper bending tool comprises a respective connecting assembly to engage or disengage a respective connecting assembly of an adjacent side upper bending tool in order to connect or disconnect adjacent side upper bending tools to one another and form said respective convoy of side upper bending tools.

13. The bending machine according to claim 12, further comprising a further actuating system acting selectively on said connecting assemblies of said side upper bending tools to mutually engage or disengage said connecting assemblies of said side upper bending tools and allow respective side upper bending tools to be connected or disconnected.

* * * * *